United States Patent [19]

Runge

[11] Patent Number: 4,608,282

[45] Date of Patent: Aug. 26, 1986

[54] FLUOROPOLYMER SURFACE LUBRICANT AND COATING

[75] Inventor: Harry V. Runge, Reston, Va.

[73] Assignee: Flourocarbon Technologies, Inc., Annapolis, Md.

[21] Appl. No.: 722,725

[22] Filed: Apr. 11, 1985

Related U.S. Application Data

[63] Continuation-in-part of Ser. No. 722,724, Apr. 11, 1985.

[51] Int. Cl.[4] ..... B05D 3/02; C10M 105/52

[52] U.S. Cl. ..... 427/385.5; 208/18; 252/12; 252/58; 427/388.2

[58] Field of Search ..... 427/385.5, 388.5; 252/49.8, 49.9, 12, 12.2, 12.6, 58; 208/18, 19, 22, 23

[56] References Cited

U.S. PATENT DOCUMENTS

| | | | |
|---|---|---|---|
| 3,159,577 | 12/1964 | Ambrose et al. | 252/58 |
| 3,445,393 | 5/1969 | Hinds | 252/58 |
| 3,573,230 | 3/1971 | Voorhees | 427/385.5 X |
| 3,843,534 | 10/1974 | Gates et al. | 252/49.8 X |
| 3,904,575 | 9/1975 | Satokawa et al. | 260/32.8 R |
| 4,127,491 | 11/1978 | Reick | 252/16 |
| 4,203,856 | 5/1980 | Pardee | 252/58 X |
| 4,284,518 | 8/1981 | Reick | 252/16 |
| 4,333,840 | 6/1982 | Reick | 252/16 |
| 4,349,444 | 9/1982 | Reick | 252/16 |
| 4,362,634 | 12/1982 | Berens et al. | 252/49.5 |
| 4,396,514 | 8/1983 | Randisi | 252/30 |
| 4,444,649 | 4/1984 | Dvoracek | 252/49.8 X |
| 4,465,607 | 8/1984 | Cottell | 252/58 |
| 4,472,290 | 9/1984 | Caporiccio et al. | 252/49.9 X |

OTHER PUBLICATIONS

U.K. Patent Application 2 090 284 A; Inventor: John L. Scheld, filed 5/29/81, published 7/7/82.

Vapor Degreasing with Chlorothene VG Solvent, published by Dow Chemical Company.

Orr, W. K.; J. H. McGee, "Racing Yacht Drag Reduction Holds Promise for Larger Vessels" Sea Technology, Jan. 1984.

Orr, W. K.; J. H. McGee, "Corrosion Treatment May Offer Electrochemical Protection" Sea Technology, Jun. 1984.

*Primary Examiner*—Thurman K. Page

*Attorney, Agent, or Firm*—Willian Brinks Olds Hofer Gilson & Lione Ltd.

[57] ABSTRACT

The invention is a composition for coating surfaces with a thin film containing fluoropolymer particles, a method for producing this composition, as well as a method for applying it to a surface. More particularly, the composition includes a carrier medium, such as a synthetic base stock, which has particles of a fluoropolymer, such as ground and sintered polytetrafluoroethylene, well dispersed within it. A solvent, such as 1,1,1-trichloroethane, is blended with the fluoropolymer containing carrier medium, most preferably in either a 32 to 1 ratio or an 8 to 1 ratio. The result is a low viscosity dispersion of the carrier medium, which itself has a dispersion of the fluoropolymer particles. When the composition is applied to a surface, the lowered viscosity aids in obtaining a thinner film of the grease and also enhances the penetration of the fluoropolymer particles into the surface. Advantageously, the solvent is allowed to evaporate from the surface, thus leaving an even thinner film of the grease. Also, the evaporation of the solvent returns the grease to a higher viscosity which is better retained on the surface. Preferably, the grease also contains a phosphate ester, such as tricresyl phosphate, which is thought to aid in dispersing the fluoropolymer particles in the grease, and in attaching the fluoropolymer particles to the surface.

28 Claims, No Drawings

FLUOROPOLYMER SURFACE LUBRICANT AND COATING

This application is a continuation-in-part of U.S. patent application Ser. No. 722,724, by the same inventor and filed on 04-11-85; the entire disclosure of which is incorporated herein by reference.

BACKGROUND OF THE INVENTION

The present invention relates to the field of lubricants and protective coatings. More particularly, the invention relates to lubricants and protective coatings incorporating fluoropolymer particles.

Because of their remarkably low coefficient of friction as well as their high level of inertness, fluoropolymers, such as polytetrafluoroethylene, have gained widespread acceptance for reducing surface friction and as protective coatings. In particular, polytetrafluoroethylene (PTFE) has been used on various types of surfaces from the familiar frying pan to rubbing parts or valves in complex apparatus, such as artificial human hearts. Unfortunately however, the cost of either making entire parts from PTFE or applying PTFE coatings to existing surfaces is relatively expensive.

Considerable research has been carried out involving the incorporation of minute solid fluoropolymer particles in grease and oil based lubricants to thereby achieve some of the benefits of the fluoropolymers in a fluid medium. In particular, several engine oil additives which include dispersed particles of fluoropolymers are disclosed in the patent literature. For example, U.S. Pat. No. 3,933,656 to Reick, teaches a modified lubricant for an internal combustion engine which comprises a major amount of a conventional motor oil, with a minor amount of of submicron size PTFE particles, and a neutralizing agent to stabilize the dispersion to prevent agglomeration and coagulation of the particles. In this and several other patents, the theory is proposed that the lubricating action of PTFE containing medium is enhanced by virtue of the fact that the PTFE particles somehow become attached to the surfaces, particularly within the pores, of the engine thus lubricated, thereby creating a renewable coating of PTFE.

Naturally, substantial effort has been expended in this field to optimize the effectiveness of these PTFE containing lubricants as well as to minimize the problems associated therewith. In particular, much has been done to prevent the otherwise inherent problems of agglomeration, coagulation, and settling of the PTFE particles. For example, British patent application No. 2,090,284 teaches the method of coating the PTFE particles with a "buoyant" carrier with a relatively low specific gravity, after which the coated PTFE particles are dispersed in a heavier oil, i.e. one with a higher specific gravity such as mineral oil. In this way, the PTFE particles which have an even higher specific gravity are "floated" in the oil. For examples of other methods of obtaining a dispersion of PTFE particles in a carrier lubricant see U.S. Pat. Nos. 4,127,491; and 4,396,514.

One limitation with many of the PTFE containing liquid lubricants involves the fact that the oils and greases used to effect good dispersion of the particles have been of relatively high viscosity. These high viscosity oils, and greases although well suited for applications such as in crankcases or wheel bearings for automobiles, are undesirable for other applications such as for lubricating weapons or for coating exposed surfaces for corrosion protection. Also, the high viscosity lubricants are difficult if not impossible to apply in a spray format, particularly without the use of a high pressure aerosol container. Furthermore, the higher viscosity oils display a more limited amount of surface penetration.

U.S. Pat. No. 4,333,840 to Reick, discloses a "hybrid PTFE lubricant" wherein the viscosity of a PTFE containing medium was lowered by blending the original PTFE oil with a second oil of lower viscosity. This patent recites the advantage that the lower viscosity PTFE oil is better suited for use with weapons, particularly as a lubricant and corrosion protector.

Although the hybride PTFE oil disclosed by Reick has a lower viscosity and may therefore be better suited for certain applications such as weapons, it also faces certain limitations. In particular, because the oil is now of a lower total viscosity, its retention on surfaces will likely be limited. That is, the lighter oil carrier for the PTFE tends to be more easily removed from the surfaces to which it is applied.

In the copending application, Ser. No. 722,724, by the same inventor and of which this application is a continuation in part, at least a partial solution to some of the above problems is disclosed. In that application, the inventor disclosed an improved fluoropolymer surface penetrating lubricant wherein a fluoropolymer containing lubricant, such as a mineral oil with ground and sintered particles of polytetrafluoroethylene (PTFE) dispersed therein, is diluted with a solvent, such as the 1,1,1-trichloroethane based solvent produced by THE DOW CHEMICAL COMPANY under the tradename of "Chlorothene VG". The resultant composition is better suited to apply to surfaces as it has a temporarily lowered viscosity. The solvent is intended to evaporate after the composition is applied, thus leaving a thin, fairly viscous film of fluoropolymer containing lubricant on the surface. It was also noted that in this diluted format, the fluoropolymer lubricant was better able to penetrate the pores of the surface to be coated, thereby achieving better attachment of the particles and also facilitating enhanced corrosion protection of the surface.

It was observed by the inventor that coating a surface with a fluoropolymer containing lubricant in this way, had the effect of lowering the coefficient of friction for the surface, particularly in connection with the fluid drag on the surface. Unfortunately, the full potential of this benefit was not realized by the compositions therein disclosed. In particular, it was found that the carrier lubricant medium for the fluoropolymer particles, e.g. mineral oil, which was left on the surface was detrimental to the reduction of fluid drag on the surface. That is, the oils used left a residual "oiliness" or tackiness to the surface which was counterproductive to the objective of reducing fluid drag on the coated surface. This was found even when the surface was wiped off to remove excess oil. In addition, the residual oil was detrimental in that dirt and other minute debris may adhere to it. As a result, the inventor found that, although the composition produced according to his co-pending application Ser. No. 722,724 has performed remarkably well in numerous other situations, it did demonstrate certain problems in this particular situation where the fluoropolymer coating is inteded to reduce fluid drag on the surface.

SUMMARY OF THE INVENTION

The general object of the present invention is therefore to alleviate the aforementioned problems and to provide an improved composition for applying a thin film containing solid particles of a fluoropolymer, a method for preparing this composition, as well as a method for coating a surface with a thin film containing solid particles of a fluoropolymer. It is also a general object of the present invention to provide a composition and method for coating a surface with a thin film containing fluoropolymer particles wherein the thin film is not oily or otherwise detrimental to the fluid drag characteristics of the surface.

Briefly, the improved composition comprises a mixture of a carrier medium comprising a grease; a quantity of fluoropolymer particles, such as ground and sintered particles of polytetrafluoroethylene, which are well dispersed in the carrier medium; and a solvent, such as a vapor degreasor, which dilutes the carrier medium and also is adapted to evaporate after the composition is applied to a surface. Surprisingly, it has been found that, when using a carrier medium which comprises a grease as opposed to an oil, the composition performs better in reducing fluid drag on the surfaces to which it is applied.

In accord with one embodiment of the invention, the carrier medium is based on a synthetic grease. The fluoropolymer particles comprise ground and sintered polytetrafluoroethylene (PTFE) particles in the size range of between about 0.5 microns to about 20 microns. It is important that these particles be well dispersed in the carrier medium in order to prevent coagulation, agglomeration, and/or settling. Also, a quantity of tricresyl phosphate is added to the carrier medium for the purposes of improving the dispersion of the PTFE particles in the carrier medium and enhancing the attachment of the PTFE particles to the surface. The solvent component of the composition comprises 1,1,1-trichloroethane with an inhibitor added to prevent degradation of the 1,1,1-trichloroethane. Such a solvent is currently marketed by THE DOW CHEMICAL COMPANY under the tradename of "Chlorothene VG". (Both "Chlorothene" and "Chlorothene VG" are considered trademarks by THE DOW CHEMICAL COMPANY.) Because of its relatively low toxicity and it nonflammability, this Chlorothene VG solvent has been found particularly well suited for use in the present invention.

Briefly, the method of producing the composition comprises the steps of: providing a carrier medium comprising a grease, dispersing a quantity of fluoropolymer particles in the carrier medium, and adding a quantity of a solvent which is capable of diluting the carrier medium and is adapted to evaporate after the composition is applied to a surface.

In accord with another embodiment of the invention the method includes the steps of prewetting the PTFE particles with aliphatic naptha before blending them in with the other constituents of the grease. Also, the dispersion of the PTFE particles in the carrier medium is enhanced by the addition of a dispersant compound such as a phosphate ester, preferably tricresyl phosphate, which is also thought to aid in attaching the PTFE partilces to the surfaces to be lubricated and protected. After the dispersion of the PTFE particles is achieved in the carrier medium, the solvent, preferably Chlorothene VG, is blended in thereby diluting or "thinning" the PTFE containing medium. As a result, the PTFE grease is provided with a temporarily lower viscosity as the solvent will evaporate after application to the surface.

Briefly, the method of coating a surface with a thin film containing fluoropolymer particles comprises the steps of providing a carrier medium with particles of a fluoropolymer dispersed therein; adding a solvent to dilute the carrier medium; applying the mixture to a surface; and allowing the solvent to evaporate from the mixture.

In yet another embodiment of the invention, the method of coating includes an applying step wherein the mixture is sprayed onto the surface. Also in this embodiment, after the solvent has evaporated, the surface is buffed to increase surface penetration by the fluoropolymer particles.

DESCRIPTION OF THE PREFERRED EMBODIMENTS

The following is a description of the preferred embodiments of the present invention. At present, one preferred method of producing the coating composition of the present invention is to start with a specially formulated grease that has particles of polytetrafluoroethylene already well dispersed therein. Particularly, it is most preferred to use a PTFE containing grease which is currently marketed by the TRIBOPHYSICS CORPORATION of Wayne, N.J. under the tradename of "T6". This particular grease is comprised of ground and sintered PTFE particles, present in about 1–6 weight percent, which are dispersed in a synthetic base stock. The grease also comprises tricresyl phosphate which is beneficial in helping to disperse the particles and also is thought to aid in attaching the particles to the surface to be coated. In addition, the "T6" grease includes extreme pressure additives as well as small amounts of anti-oxidizers and corrosion inhibitors, such as dodecin succinic anhydride.

Other fluoropolymer containing greases which have varying properties in the grease and the fluoropolymer particles are commercially available, for example "superlube" by SYNFUELS, INC; "Fomblin Y-VAC3" by MONTEFLUOS, MONTEDISON GROUP; "WGL" by ALLEGRIA; "Magnagrease" by MAGNALUBE, INC. Accordingly, based on the particular needs of the application, it may be desirable in alternative embodiments to use these other fluoropolymer greases to produce the coating composition of the present invention.

In another preferred embodiment the coating composition is produced by starting with the fluoropolymer particles and adding the carrier medium to them. In this preferred method, the fluoropolymer particles are ground and sintered particles of polytetrafluoroethylene (PTFE). Ground PTFE particles are used because of their durability and because of their inertness and electrostatic neutrality, the latter characteristics being important in keeping the particles from agglomerating. In addition, the particles are sintered because sintered PTFE particles typically have smoother surfaces and a more uniform geometry than non-sintered particles.

The size of the PTFE particles is selected in consideration of at least two factors. First, the particle size is selected to be best suited for the surface to be coated. Since one of the theories of operation of the present invention is that the PTFE particles actually become attached within the pores of the surface thus coated, the particle size may be altered to optimize the effects on particular types of surfaces. Second, it has been found to be more difficult to keep the larger size PTFE particles dispersed in the carrier medium. Preferably, the PTFE particles have an estimated spherical diameter of below 7 microns for about 90% of the particles.

PTFE particles manufactured by LIQUID NITROGEN PRODUCTS CORPORATION of Phildelphia, Pa., under the designation TL 102 have proven particularly well suited in this preferred embodiment. The PTFE is provided in powdered form.

Preferably, the PTFE particles are wetted with a compound such as aliphatic naptha or kerosene before they are mixed with the carrier medium. This wetting step has been shown to help separate the particles and thereby inhibit agglomeration.

Next, the particles are blended at high speed into the carrier medium. In one preferred embodiment, the carrier medium comprises a gel which is a blend of polyol esters manufactured by Stauffer Chemical Company under the designations 704 and 810. The 704 composition is adapted for use at low temperatures and the 810 composition is adapted for use at high temperatures. Preferably, the two compositions are blended in a 1 to 1 ratio by weight. Alternatively, the proportions can be varied to suit a particular temperature requirement.

Also in the preferred embodiment, there are certain additives which are blended with the gel. These additives are included in minor amounts to improve various properties of the grease. For example, anti-oxidizers, corrosion inhibitors, bactericides, etc. may all be added to the grease. The only requirement in connection with the present invention is that these additives all be compatible with the other constituents of the coating composition to be produced. Most preferably, the grease used in the present invention includes dodecin succinic anhydride added as a corrosion inhibitor. The dodecin succinic anhydride is added in a minor amount, such as 0.4% by weight of the final composition. In alternative embodiments, other such additives may be blended into the grease. It is considered within the ordinary skill in the art to select such additives which satisfy the requirements of a particular application and which are compatible with the other constituents of the coating composition.

In the preferred embodiment, the carrier medium also comprises a phosphate ester, which is most preferably either tricresyl phosphate or triaryl phosphate. The tricresyl phosphate can be obtained from The STAUFFER CHEMICAL COMPANY under the designation 8484. This tricresyl phosphate is a synthetic phosphate ester. Tricresyl phospate has important advantages when used in this invention. For years, it has been used as an additive for high pressure oils and greases. Also, it has been shown that tricresyl phosphate tends to attach to scarred places, in a cylinder wall for example, and prevents further abrasion in that area. For this reason, it is theorized by the inventor that the tricresyl phosphate aids in bonding the PTFE particles to the surfaces to be coated.

It has also been found that triaryl phosphate performs about as well as tricresyl phosphate and may therefore be desirable to use because of its lower price. Triaryl phosphate, which is a synthetic substitute for tricresyl phosphate, can also be obtained from The STAUFFER CHEMICAL COMPANY with a designation of 8478. Also, it has been found that dithiocarbamates such as lead idamyldithiocarbamate and zinc dialkyldithiocarbamate can be used as high pressure lubricant additives where it is desired to produce a phosphorus-free lubricant composition. These materials are thought to perform a function similar to that performed by the tricresyl phosphate.

Preferably, the prewetted PTFE particles are blended into the carrier medium, i.e. the gel with its additives and the phosphate ester at high speeds, e.g. 4,000 rpm, for approximately 30 minutes. This blending is most preferably performed while the mixture is kept under a vacuum of at least 29.8 inches at standard barometric pressure of 29.92 inches. The preferred proportions of this PTFE containing medium are as follows: 1 part prewetted PTFE particles to 1 part tricresyl phosphate to 2 parts gel.

At this point, what has been produced is a relatively high viscosity PTFE containing grease which has utility in and of itself as a grease or a grease additive. It is important to note that the process thus described for producing a PTFE containing medium is believed to be similar to the process for producing the fluoropolymer grease marketed by TRIBOPHYSICS CORP. of Wayne, N.J., under the tradename "T6". Accordingly, neither this process nor the composition of the PTFE grease thus produced is considered part of the present invention. Although presently considered preferable to either obtain this particular PTFE containing medium or to produce it according to the above described process, it should be clear that the inventor considers it within his invention to either start with another fluoropolymer containing grease or to produce a fluoropolymer containing grease according to other methods.

Returning to the preferred embodiment, once the PTFE containing grease is obtained, a quantity of a solvent is added to dilute that grease. It was a somewhat surprising result to observe that when the fluoropolymer grease was diluted in a solvent, the particles of fluoropolymer did not settle, agglomerate or coagulate. That is, it was unexpected that one could keep the particles dispersed within the grease when that grease was in turn dispersed in the solvent. This is particularly true in light of the fact that the fluoropolymer particles have a relatively high specific gravity. However, it has been found that the solvent Chlorothene could be added in quantities up to 32 parts Chlorothene to one part PTFE grease without experiencing coagulation or agglomeration problems. It was noted that at the higher concentrations of Chlorothene that there was some settling occuring if the containers were left undisturbed for long periods. However, the PTFE particles were easily put back into dispersion by simply shaking the container.

Preferably the solvent comprises a halogenated hydrocarbon in liquid form. Most preferably, the solvent is a form of 1,1,1-trichloroethane presently produced by THE DOW CHEMICAL CO. and sold under the tradename of "Chlorothene VG". The Chlorothene solvent is a proprietary product of DOW primarily sold for vapor degreasing and cold cleaning operations. According to product literature, Chlorothene VG is constituted of about 94% 1,1,1-trichloroethane, has a maximum of 1% of halogenated impurities, and incorporates an "inhibitor" system for stabilizing its composition.

Chlorothene VG is the most preferred solvent to add to the fluoropolymer containing medium in the present invention for at least three reasons. First, it has been shown that Chlorothene is capable of disolving the PTFE grease to a sufficient extent to be well suspended within the solvent/grease mixture without causing settling, coagulation, or agglomeration of the PTFE particles.

The second and third reasons that Chlorothene is most preferred as the solvent in the present invention is that it has relatively low toxicity and is nonflammable. These two criteria are important because many uses for the present invention will involve a spraying operation wherein the solvent is allowed to evaporate. In *The Merck Index* (9 th Ed.), "Chlorothene" is listed as a common name for 1,1,1-trichloroethane. Also, in *The Merck Index,* 1,1,1-trichloroethane is reported to be nonflammable with a freezing point of −32.5° C., a boiling point of 74.1° C., and no flash point. According to the product literature from Dow, the inhibitor system in Chlorothene is selected to have similar thermal properties as the 1,1,1-trichloroethane.

The solvent is added to the PTFE containing medium in proportions ranging from 1 part solvent to 1 part grease all the way to 32 parts solvent to 1 part grease. As mentioned it was found that, at the higher concentrations of solvent, such as those above 32 parts solvent to 1 part grease, there was some settling of the particles if containers of the mixture were left undisturbed for long periods of time, such as 6 months. However, in these cases, the particles were easily redispersed with simple agitation of the liquid. This minor settling should be contrasted with agglomeration or coagulation wherein, once the particles have become separated, they cannot be redispersed through any amount of agitation. It is therefore an important advantage of the present invention that the PTFE particles remain well dispersed over long periods of time and that even when there is some sedimentation, it is not irreversible or serious.

The preferred proportion for solvent to grease varies depending on the intended use. For providing a lubricating coat on a surface, 8 parts solvent to 1 part grease is preferred. For providing a coating primarily for reduction of fluid drag and corrosion protection, 32 parts solvent to 1 part grease is preferred. When using this 32 to 1 ratio, it is also preferred to first blend the solvent and grease in an 8 to 1 ratio, and then to dilute that to the 32 to 1 ratio just prior to use.

The solvent may be blended with the PTFE containing medium through simple techniques. For example, small amounts have been mixed with a common "whisk" chucked in an ordinary handheld electric drill. The solvent and grease mixture is blended this way for about 15 minutes at relatively high speed. This blending is important in creating an even dispersion of the PTFE grease within the solvent.

The resultant blend is a homogeneous mixture of the PTFE containing medium and the solvent. This mixture may be stored in polyethylene or metal containers, or any other type of container which is not affected by the Chlorothene solvent.

As stated briefly above, the composition of the present invention is useful as a surface lubricant and/or protective coating. In particular, because the composition of the present invention comprises a fluoropolymer containing medium which is now in a temporarily diluted format, the fluoropolymer grease may be applied to surfaces in a more efficient and precise manner. In other words, the composition of this invention includes a grease with a dispersion of fluoropolymer particles, which grease has itself been dispersed in a less viscous medium, the solvent. In addition, because the solvent used is intentionally volatile, the solvent evaporates after application, thereby returning the grease to its original viscosity. This is thought to be highly beneficial as it allows the grease to be applied in thin films to a wider variety of surfaces. Also, the temporary lowering of the viscosity is thought to be important in allowing the fluoropolymer grease to better penetrate the pores of the surfaces to be coated, with the added benefit that once in the pores of the surface, the solvent evaporates whereby the grease is more likely to remain in the pores. Expressed in yet another way, the invention allows one to apply a fluoropolymer grease in just the right amount to just the right spot.

A further advantage of the present invention is that when the above described composition is properly applied to a surface, there is no residual oiliness or tackiness on the surface. That is, a good slick surface is provided by applying this coating composition, even without any post-application treatment. This is different than the result normally obtained with the oil based composition of the co-pending application wherein residual oil produces a sticky and messy surface. It was surprising for the inventor to observe this improvement caused by the incorporation of grease into the carrier medium. Specifically, it was orginally thought that incorporating a grease into the medium would only produce a worse result. That is, a grease which is thicker and stickier than the oils was expected to leave an even worse surface than the oil. However, there is instead a noticeable improvement in the surface condition after application. This is particularly important in the situation where the composition is applied in order to reduce fluid drag on surfaces such as boat hulls and aircraft.

Another advantage which has been demonstrated by the composition of this invention is a remarkable capacity to prevent debris attachment, particularly in marine applications. For example, when applied to the hull of a boat, the coating has not only reduced the fluid drag on the boat, but has also been surprisingly effective in preventing barnacle attachment. Specific cases will be discussed in the Examples section to follow.

The preferred method of applying the composition of the invention is as follows. First, a quantity of the composition as described above is obtained. The composition is then applied to a clean surface, preferably by spraying. It is highly desirable to clean, most preferably with Chlorothene VG, the surface to be coated before applying the composition.

To actually apply the composition, spraying is preferred. In particular, when doing small surfaces, a hand operated pump sprayer works satisfactorily. An advantage of this invention is that because the viscosity of the grease is temporarily lowered to such an extent, the grease can be sprayed without the aid of a pressurized aerosol container. This advantage is important in that there are certain environments, such as on board an airplane, where pressurized aerosol containers are undesirable.

For larger jobs, the composition may be sprayed using a motorized compressor and spray gun. Alternatively, the composition can be painted on with a brush or cloth, or it can be applied by dipping the surface to be coated. It is preferable to apply more than one coat of the composition. Before applying each successive coat, the solvent from the prior coat should be allowed to evaporate completely. Also, reapplication to the surface after extended periods of time is most likely desirable. Unfortunately, the criterion affecting the length of time between applications are not completely understood. However, it is deemed within the skill in the art to determine when a new application is needed. Preliminary tests on boat hulls show that each application should be effective for a year or more.

Preferably, the composition and the surface to be coated should be at least 60° F. In order to best facilitate adsorption and penetration, the temperature should be between 90° and 100° F. At these temperatures, the 32 to 1 mixture leaves a coating on the surface which does not smear.

As stated above, after the composition is applied to the surface, the solvent evaportes, thus leaving only the PTFE grease on (or in) the surface. Most preferably, the surface is also buffed after the composition is applied to it in order to work the grease into the surface. That is, it is beneficial to apply heat and pressure to the surface to enhance penetration of the grease into the surface. It is important to note that even without this buffing step, when the coating composition comprises a grease instead of an oil, the surface is not oily or tacky after applying the composition when applied at the optimum temperature of 90°–100° F. at a ratio of 32 parts solvent to 1 part grease. This is in contrast to the condition of the surface after applyng an oil based composition according to the co-pending application Ser. No. 722,724, wherein the coating left an oily surface. This is an important advantage of using grease instead of oil, particularly in the situation where the surface is being coated in order to lower fluid drag.

It should be noted that not all materials are compatible with the solvents used in the invention. It is deemed within the ordinary skill in the art to either obtain data from the manufacturer of the solvent or to perform experiments to determine the compatibility of the solvent with the particular surface. For example product literature for Chlorothene VG is available which lists the effects if any when it comes in contact with different materials. Generally, Chlorothene has been found to be compatible with most surfaces for which the product is intended to be used, particularly considering the fact that the Chlorothene does not remain in contact with the surface for very long. In various tests the composition made with Chlorothene has been applied to painted or unpainted metal, fiberglass, glass, nylon, dacron, kevlar, neoprene, asbestos gasket material, dacron polyester, acrylic plexiglass, polyethylene, printed circuit boards with integrated circuits soldered and hard wired.

In addition, it should be noted that when working with any volatile solvent, one should take care to avoid overconcentration of the solvent in the working environment. It is considered with the ordinary skill in the art to become aware of the safety precautions prescribed by the manufacturer of the solvent used.

The observed result of applying the composition to a surface is that a thin film of PTFE containing medium is thereby deposited on the surface. While not wishing to be bound by any particular theory, the inventor has theorized that the individual particles of PTFE are in some way attached to the surface, and particularly within the pores of the surface. This is thought to be why the lubricating and coating layer works well even after the surface is wiped clean of the any residue left on top of the surface. Also, when using tricresyl or triaryl phosphate, it is thought that these phosphate esters somehow enhance the bonding of the PTFE particles to the surface. This condition of having the PTFE particles bonded to the surface lowers the coefficient of friction of the surface. Naturally, this is beneficial for rubbing surfaces. In addition, it has also been shown to reduce fluid drag on the surface. Such a result is highly beneficial when coating surfaces such as boat hulls and aircraft.

It has also been observed that coating a surface with the composition of the invention has significant anticorrosion benefits. In particular, considerable corrosion testing of the composition of this invention has been conducted in accordance with Military Specification MIL- STD-810C. This testing has involved dissimilar metal combinations; aluminum alloys, stainless steel, copper, high carbon steels, cold rolled steel, and aircraft wing sections. The surfaces coated as described above with the composition of this invention have demonstrated significant and reproducable control of corrosion.

Although the precise physical processes or mechanisms producing these results are not fully understood by the inventor, the inventor's current hypothesis is as follows. It is known that PTFE is highly hydrophobic. As a result, it is thought that the particles of PTFE which attach within the pores of the surface repel and also replace the water in the pores. It is also thought that the phosphate esters, such as tricresyl phosphate, used in the preferred embodiments, in some way contribute to this protection of the coated surface, although the mechanism is not understood.

In regard to corrosion protection, it is considered important that the addition of the solvent to the fluoropolymer grease has allowed the grease to better penetrate the surface and thereby provide improved corrosion protection. Likewise, it is considered important that the solvent evaporates and leaves a more viscous grease which is better retained on the surface.

Again comparing the present invention with that in the co-pending application referred to above, it is presently thought by the inventor that the inclusion of a grease in the carrier medium is beneficial to the composition's function of corrosion protection. Particularly, it is believed that because the grease is more viscous than the oil that it will therefore be better retained on the surface than the oil, and that it will also be less permeable.

EXAMPLES

A quantity of the grease marketed by the TRIBOPHYSICS CORP. under the tradename "T6" was obtained. As a first example, 1 fluid ounce of this grease was diluted with 8 fluid ounces of the 1,1,1-trichloroethane solvent Chlorothene VG. Specifically, the Chlorothene was gradually added to the grease then blended at high speed for approximately 15 minutes. Eight fluid ounces of a milky white liquid was thereby obtained. This liquid was tested on boat hulls, and performed well.

As a second example, the same procedure was followed except that 32 fluid ounces of Chlorothene were added to the grease thereby producing a 32 to 1 ratio. Again the result was a milky white liquid. This liquid performed well in boat and aircraft tests.

To date, the composition was undergone testing on boats and aircraft. On boats the composition has been applied to hulls for drag reduction and also applied to topside fittings for corrosion prevention. In tests wherein the composition was applied to the hulls of boats, two significant results were observed. First, a reduction in the fluid drag on the boat was witnessed. In particular, after having its hull treated with the composition, a Bristol 42 Trawler showed a significant improvement in the speed to RPM ratio. In another test, a Hatteras 45 powerboat recorded an improvement in miles per gallon after having its hull coated.

The second result observed in these boat tests was a notable reduction in marine growth and debris attachment on the hulls which were treated. In particular, the composition was applied to a Gulfstar 50 sailboat, berthed in the Severn River at Annapolis, Md. and which has been in the water for 27 months. In that time, a slime was the only marine growth observed. Significantly, there was no barnacle attachment.

The composition has also been applied to outer surfaces of aircraft. In particular, aircraft coated with the composition have demonstrated reduced air drag.

It should be noted that, although much of the discussion has dealt with the lubrication and protective coating of boats and aircraft, the invention is not limited to these applications. In addition, although much of the discussion has involved the use of the specific PTFE containing grease marketed by TRIBOPHYSICS as "T6", the invention is not limited to using this particular fluoropolymer grease. Furthermore, although much of the discussion has involved the use of the solvent marketed by THE DOW CHEMICAL CO. as "Chlorothene VG", the use of other solvents is within the scope of this invention. In sum, it should be born in mind that the above description of the specific embodiments and examples are to be interpreted as exemplary and explanatory rather than limiting. Certainly, it is the following claims which define the scope of the present invention.

What is claimed is:

1. A composition for coating a surface with a thin film containing particles of a fluoropolymer comprising:

a dispersion comprising a carrier medium and fluoropolymer particles, said carrier medium comprising a grease; and a solvent means for diluting said dispersion, said solvent being adapted to evaporate after application of the composition to the surface.

2. The composition of claim 1 wherein the fluoropolymer particles comprise polytetrafluorethylene.

3. The composition of claim 2 wherein the particles are ground and sintered.

4. The composition of claim 1 wherein the carrier medium comprises a phosphate ester.

5. The composition of claim 4 wherein the phosphate ester is selected from the group consisting of tricresyl phosphate and triaryl phosphate.

6. The composition of claim 1 wherein the solvent means is nonflammable.

7. The composition of claim 1 wherein the solvent means comprises 1,1,1-trichloroethane.

8. The composition of claim 1 wherein the proportion of solvent means to carrier medium is between about 8 to 1 and 32 to 1.

9. The composition of claim 1 wherein the proportion of solvent means to carrier medium is about 8 to 1.

10. The composition of claim 1 wherein the proportion of solvent means to carrier medium is about 32 to 1.

11. A composition for coating a surface with a thin film containing particles of a fluoropolymer comprising:

a dispersion comprising a carrier medium and a quantity of polytetrafluoroethylene particles, said medium comprising a mixture of a grease and a phosphate ester selected from the group consisting of tricresyl phosphate and triaryl phosphate; and a solvent means comprising 1,1,1-trichloroethane for diluting said dispersion, said solvent means being adapted to evaporate after application of the composition to the surface.

12. The composition of claim 11 wherein the proportion of solvent means to carrier medium is between about 8 to 1 and 32 to 1.

13. The composition of claim 11 wherein the proportion of solvent means to carrier medium is about 8 to 1.

14. The composition of claim 11 wherein the proportion of solvent means to carrier medium is about 32 to 1.

15. The composition of claim 11 wherein the proportion of grease to phosphate ester is about 2 to 1.

16. The composition of claim 11 wherein the grease comprises a blend of polyol esters.

17. The composition of claim 11 wherein the carrier medium further comprises a minor amount of an anticorrosion additive.

18. The composition of claim 16 wherein the anticorrosion additive comprises dodecin succinic anhydride.

19. A method of producing a composition for coating a surface with a thin film containing particles of a fluoropolymer comprising:

providing a a dispersion comprising particles of a fluoropolymer and a carrier medium, which carrier medium comprises grease;

providing a solvent means which is capable of diluting said dispersion and is adapted to evaporate after application of the composition to the surface; and mixing the solvent means with said dispersion so that said dispersion is well dispersed in said solvent.

20. The method of claim 19 wherein said particles of a fluoropolymer remain substantially dispersed in the carrier medium.

21. The method of claim 19 wherein the particles comprise ground and sintered polytetrafluoroethylene.

22. The method of claim 19 wherein the carrier medium comprises a mixture of grease and a phosphate ester selected from the group consisting of tricresyl phosphate and triaryl phosphate.

23. A method of producing a composition for coating a surface with a thin film containing particles of a fluoropolymer comprising:

providing a dispersion comprising particles of a polytetrafluoroethylene and a carrier medium, the medium comprising a mixture of grease and a phosphate ester selected from the group consisting of tricresyl and triaryl phosphate;

providing a solvent means comprising 1,1,1-trichloroethane which means is capable of diluting the dispersion and is adapted to evaporate after application of the composition to the surface; and mixing the solvent means with the dispersion so that said dispersion is in turn well dispersed in said solvent means.

24. A method of coating a surface with a thin film containing particles of a fluoropolymer comprising the steps of:

providing a dispersion comprising particles of a fluoropolymer and a carrier medium, which carrier medium comprises grease;

providing a solvent capable of diluting the dispersion and which is adapted to evaporate after application of the composition to the surface;

mixing the dispersion with the solvent to form a mixture such that said dispersion is well dispersed in said solvent; and applying the mixture to a surface after which substantially all of the solvent evaporates thereby leaving a thin film containing the particles of a fluoropolymer on the surface.

25. The method of claim 24 wherein the surface is buffed after application of the mixture to increase surface penetration of the fluoropolymer particles.

26. The method of claim 24 wherein the fluoropolymer particles comprise ground and sintered polytetrafluoroethylene.

27. The method of claim 24 wherein the carrier medium comprises a mixture of grease and a phosphate ester selected from the group consisting of tricresyl phosphate and triaryl phosphate.

28. The method of claim 24 wherein the mixture is applied to the surface by spraying.

* * * * *